US008540594B2

(12) United States Patent
Chu

(10) Patent No.: US 8,540,594 B2
(45) Date of Patent: Sep. 24, 2013

(54) ILLUMINATED NOCK ASSEMBLY

(75) Inventor: Allen Chu, Taipei (TW)

(73) Assignee: The Allen Company, Inc., Broomfield, CO (US)

( * ) Notice: Subject to any disclaimer, the term of this patent is extended or adjusted under 35 U.S.C. 154(b) by 0 days.

(21) Appl. No.: 13/135,005

(22) Filed: Jun. 22, 2011

(65) Prior Publication Data

US 2011/0312453 A1 Dec. 22, 2011

Related U.S. Application Data

(60) Provisional application No. 61/398,194, filed on Jun. 22, 2010.

(51) Int. Cl.
*F42B 6/06* (2006.01)

(52) U.S. Cl.
USPC ..... 473/586; 473/570

(58) Field of Classification Search
USPC ..... 473/570, 578, 585, 586
See application file for complete search history.

(56) References Cited

U.S. PATENT DOCUMENTS

| | | | | |
|---|---|---|---|---|
| 4,340,930 | A * | 7/1982 | Carissimi | 362/204 |
| 5,134,552 | A * | 7/1992 | Call et al. | 362/203 |
| 6,123,631 | A * | 9/2000 | Ginder | 473/570 |
| 6,736,742 | B2 * | 5/2004 | Price et al. | 473/570 |
| 7,211,011 | B1 * | 5/2007 | Sutherland | 473/578 |
| 7,837,580 | B2 * | 11/2010 | Huang et al. | 473/570 |

* cited by examiner

*Primary Examiner* — John Ricci
(74) *Attorney, Agent, or Firm* — Boyd D. Cox

(57) ABSTRACT

The illuminated nock assembly of the present invention attaches to the shaft of an arrow to assist in tracking the trajectory of the arrow in flight and in locating the arrow after flight. The illuminated nock assembly includes a housing having two separate parts, lighting components and a power source. The lighting components are illuminated when arrow shaft is placed on the housing.

19 Claims, 4 Drawing Sheets

ILLUMINATED NOCK ASSEMBLY

Priority for this application is claimed from U.S. Provisional Application No. 61/398,194 entitled "Illuminated Nock Assembly" filed on Jun. 22, 2010

BACKGROUND

The present invention is directed to an illuminated nock assembly for mounting on an arrow shaft. The nock assembly is illuminated when installed on the arrow shaft, allowing a user to track the arrow's flight trajectory and to locate the arrow after flight.

It is helpful to see the trajectory of an arrow's flight in order for an archer to correct for changing factors in the field. For example, wind can greatly affect the trajectory of an arrow in flight, making it more difficult to hit a desired target. Often an arrow in flight is difficult to see, especially in low light conditions. Consequently, this can make it difficult for an archer to correct his or her aim based on various conditions that affect the arrow's flight. In addition, it can be difficult at times, to locate his or her arrow particularly in those circumstances when the archer loses sight of the arrow in flight.

Nocks have been developed that include lighting devices that can illuminate the end of the arrow shaft, making the arrow more visible during flight. However, there are several drawbacks with these nocks in the prior art. Typically, the nock of an arrow is formed by a unitary housing. Such a unitary housing makes assembly of the nock much more difficult, thereby increasing assembly costs. In addition, the electrical contacts which provide connections between the battery and the light source are often damaged during assembly. With the electrical contacts damaged, the device will not work properly to illuminate the nock. In addition, the complex molds required to manufacture the unitary housings are difficult to use and can result in increased damaged castings. All of these drawbacks can significantly increase production costs.

Therefore there is a need for an illuminated nock assembly that reduces production costs by simplifying the assembly process and that increases product reliability by minimizing damage to the electrical contacts during assembly.

Additionally, the two part housing of the present invention simplifies the manufacturing process. The two portions are double molded so each of the portions comprises generally the same thickness. Being approximately the same thickness equalizes manufacturing shrinkage and bubbling so that the two portions can be consistently manufactured to fit snugly together.

SUMMARY

The illuminated nock assembly of the present invention comprises a housing, lighting components and a power source. The housing is comprised of two separate, interfitting portions which facilitate assembling the device. The lighting components include a pair of connectors which are disposed between the two portions during assembly and extend from inside the housing's first bore to the area outside of the first bore.

It is an object of the present invention to provide an illuminated nock assembly to be mounted on an arrow shaft for use in tracking the arrow.

It is a further object of the present invention to provide a lighted nock that is lightweight.

It is a further object of the present invention to provide an illuminated nock assembly having a two part housing that comprises separable, interfitting parts.

It is a further object of the present invention to provide an illuminated nock assembly that can be readily installed on an arrow shaft and readily removed therefrom.

It is a further object of the present invention to provide an illuminated nock assembly having a housing comprised of two separable parts for containing the lighting components.

It is a further object of the present invention to provide an illuminated nock assembly having a housing that allows easier access to facilitate repairing and replacing parts of the assembly.

It is a further object of the present invention to provide an illuminated nock assembly having a housing that can be produced by a simplified manufacturing process.

It is a further object of the present invention to provide a housing for an illuminated nock assembly that can be molded to a consistent size.

BRIEF DESCRIPTION OF THE DRAWINGS

Reference is made to the accompanying drawings in which are shown illustrative embodiments of the invention and from which novel features and advantages will be apparent.

DETAILED DESCRIPTION

Figure 1:
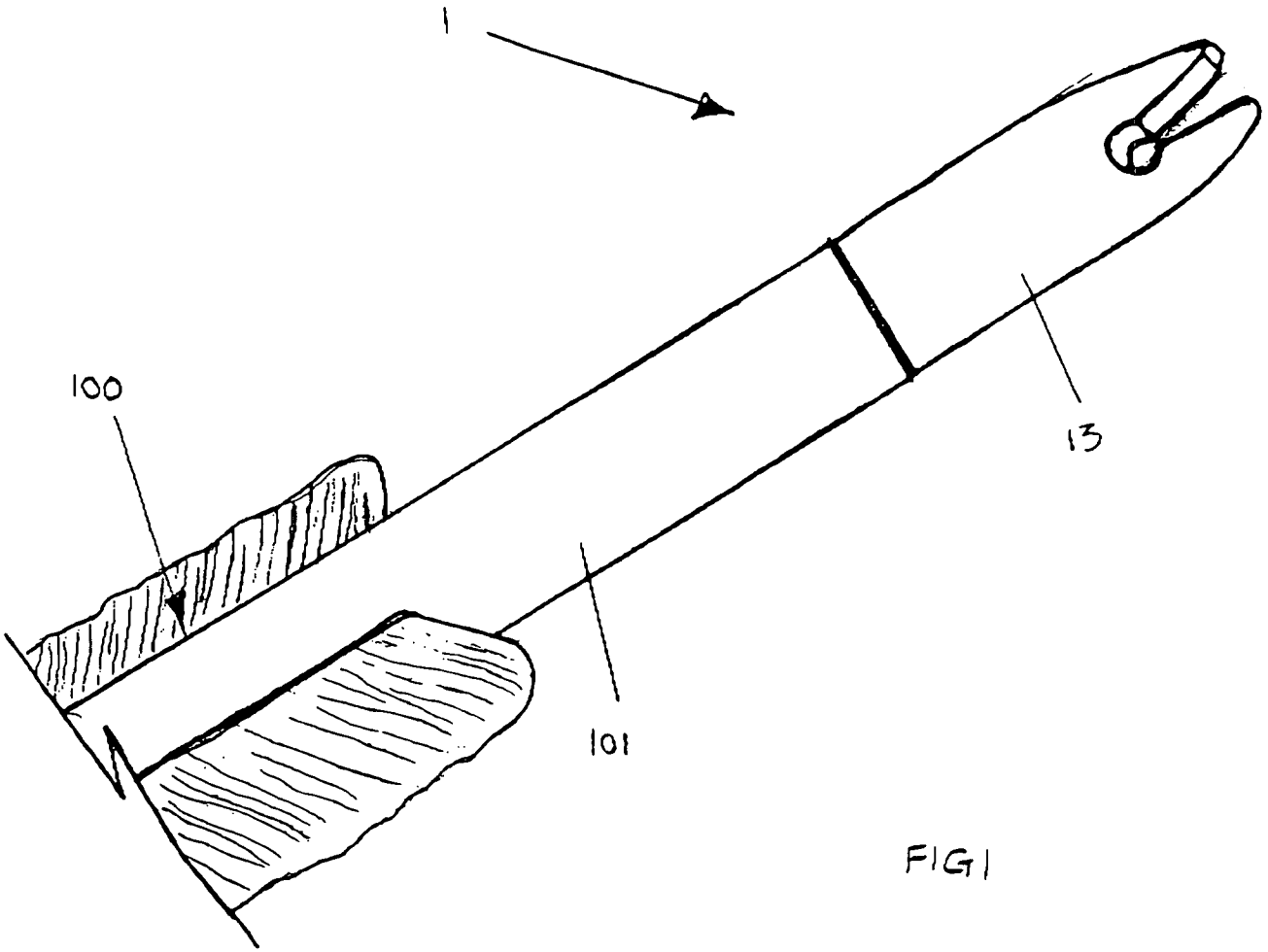
FIG. 1 is a perspective view of the illuminated nock assembly of the present invention fitted with an arrow.

The illuminated nock assembly (1) of the present invention shown in FIG. 1 is mounted on an arrow (100) having electrical conductive properties. The nock assembly comprises a housing (10), a lighting component (11) and a power source (12) as shown in FIGS. 2 and 3.

Figure 2:
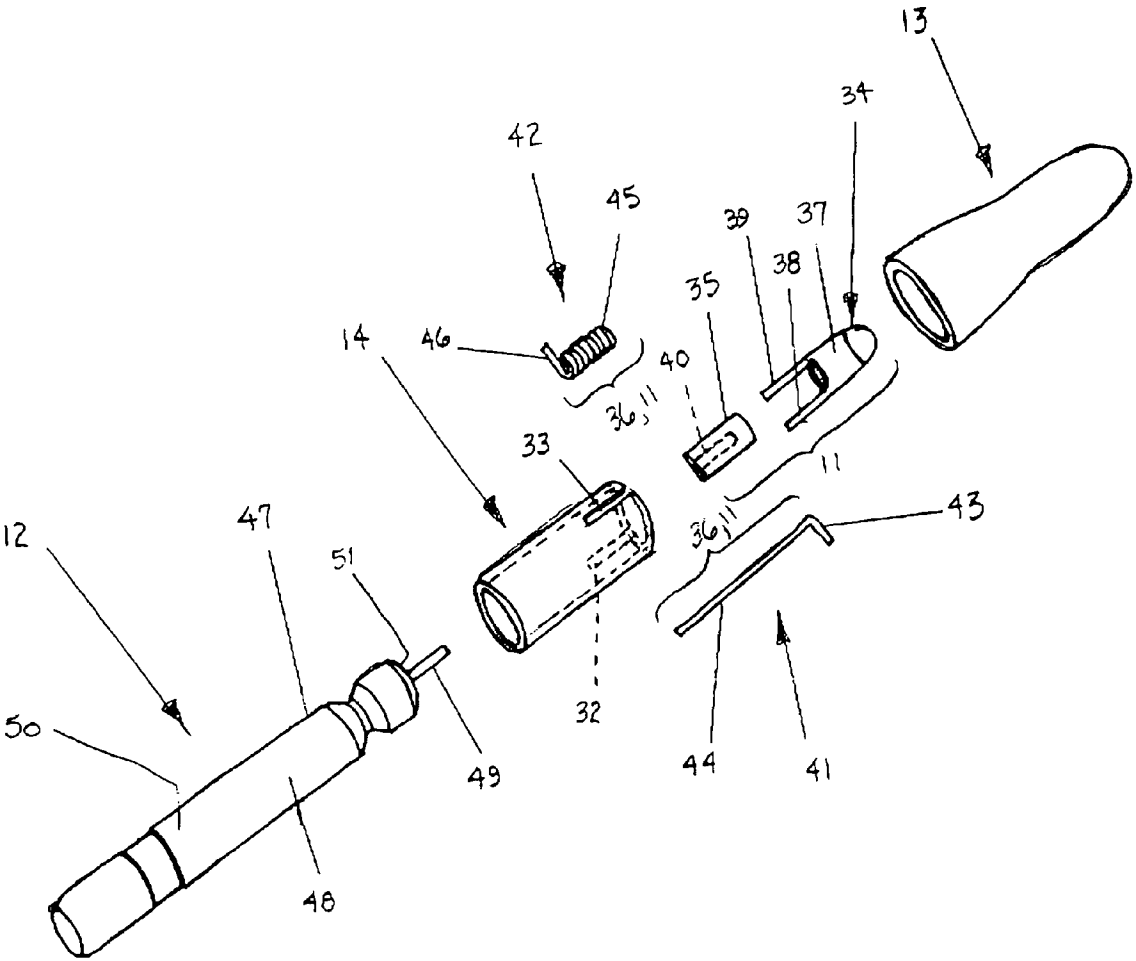
FIG. 2 is an exploded perspective view of the illuminated nock assembly shown in FIG. 1.
Figure 3:
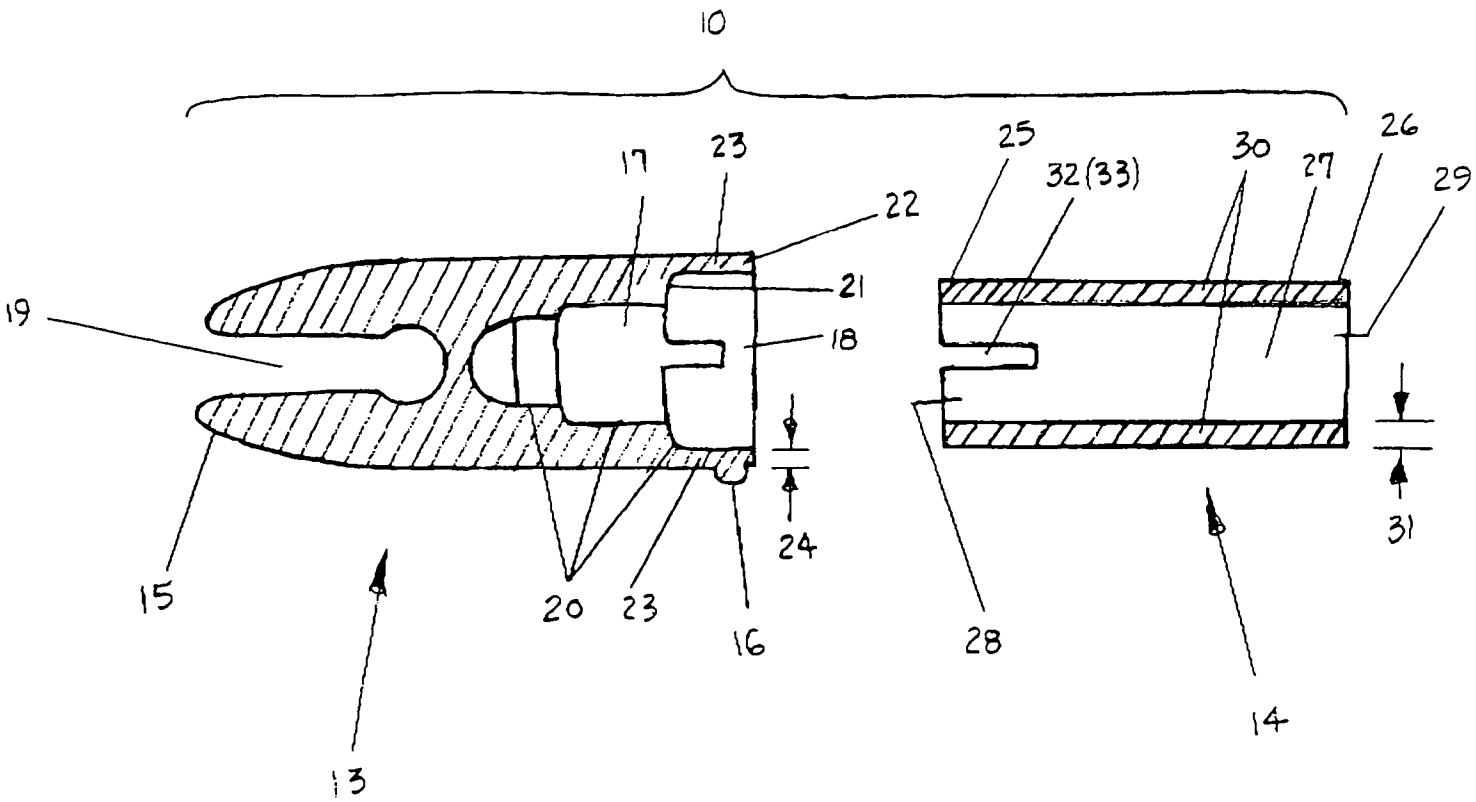
FIG. 3 is a cross-sectional side view of the housing of the illuminated nock assembly shown in FIG. 1.

The housing (10) includes two separable, interfitting parts, namely the first nock portion (13) and the second nock portion (14) as shown in FIGS. 2 and 3. The first nock portion (13) has distal (15) and proximal (16) ends with a first bore (17) having a bore opening (18). A groove (19) for engaging a bowstring is disposed on the distal end (15) of the first nock portion (13).

Within the first bore (17) is a stepped surface (20). The stepped surface (20) includes an abutment wall (21). The first nock portion (13) includes a first portion wall (23) having a first wall thickness (24) on the proximal end (16). An end wall (22) extends circumferentially around the bore opening (18).

The other part of the housing (10), the second nock portion (14), includes first (25) and second (26) ends with a second bore (27) extending therebetween. The second bore (27) has a first opening (28) extending through the first end (25) of the second nock portion (14). The second bore (27) has a second opening (29) extending through the second end (26) of the second nock portion (14) opposite the first opening (28). The second bore (27), the first opening (28) and the second opening (29) are coextensive.

The second nock portion (14) has a second portion wall (30) having a second wall thickness (31) that is approximately the same as the first wall thickness (24). Extending longitudinally from the second opening (29) and along the second portion wall (30) are first (32) and second (33) slots.

The lighting components (11) include a light source (34), a light base (35), and electrode contacts (36). Preferably, the light source (34) is a light-emitting diode (LED), but other types of suitable light sources could be used instead. The light source (34) includes a body (37) with first (38) and second (39) light leads extending outwardly from the light source's body (37). The light base (35) includes a base bore (40).

The electrode contacts (36) comprise first (41) and second (42) connectors. The first connector (41) electrically connects the power source (12) to the arrow shaft (101) and includes a first shaft contact (43) and a connecting leg (44). While the second connector (42) includes a coil (45) and a second shaft contact (46), the second connector (42) electrically connects the light source (34) to the arrow shaft (101) when the illuminated nock assembly (1) is in use.

The power source (12) for illuminating the light source (34) comprises a battery (47) having a body casing (48) and a terminal projection (49). The body casing (48) is further characterized by having sides (50) and a shoulder (51).

The housing (10) is elongated with the second bore (27) having a cross section that generally conforms to the cross sectional shape of an arrow's shaft (101). Since arrows are typically circular in cross section, the second bore (27) in the second nock portion (14) of the preferred embodiment comprises a circular cross sectional shape. However, the cross sectional shape of the second bore (27) could vary in shape to fit the particular arrow shaft shape when necessary.

In one preferred embodiment, the housing (10) is made of a hard, transparent or translucent plastic and the battery (47) comprises a 3-volt lithium battery. However, any type of suitable non-conductive material that is durable and allows light to pass through could be used instead of plastic. Likewise, other suitable types of batteries could be used in lieu of a 3-volt lithium battery.

In the lighting components (11), the electrode contacts (36) are both generally L-shaped. The first shaft contact (43) of the first connector (41) extends generally perpendicularly to the connecting leg (44) giving the first connector (41) a general L-shape. Similarly, the second connector (42) has a second shaft contact (46) that extends outwardly from the coil (45) in a generally perpendicular disposition. Both of the electrode contacts (36) are made of an electrically conductive material, preferably brass. However, other electrically conductive materials could be substituted for the brass.

The housing (10) supports the lighting components (11) which illuminate the nock assembly (1) and the power source (12) which fuels the light source (34) during illumination.

The first bore (17) in the first nock portion (13) houses the light source (34) and at least a portion of the second nock portion (14). A frictional fit between a section of the stepped surface (20) and the second nock portion (14) removably secures the first (13) and second (14) nock portions together when the illuminated nock assembly (1) is assembled. Also included on the stepped surface (20) is the abutment wall (21) which limits the distance that the second nock portion (14) can be inserted into the first bore (17) of the first nock portion (13). In addition, the groove (19) on the first nock portion (13) receives the bowstring when an illuminated nock assembly (1) and an attached arrow (100) are loaded onto the archery bow. The groove (19) also stabilizes the bowstring when the bowstring is held in the groove (19).

The second nock portion (14) secures the electrode contacts (36) to the housing (10). Specifically, the first slot (32) on the second nock portion (14) holds the first connector (41) in place on the housing (10) and the second slot (33) holds the second connector (42) on the housing (10).

The end wall (22) on the first nock portion (13) acts as a stop limit for an arrow (100) as the arrow shaft (101) is fitted onto the nock assembly (1). Furthermore, the end wall (22) comes into contact with the electrode contacts (36). When the light source (34) is illuminated during use, the arrow shaft (101) is pressed against the end wall (22) and in direct contact with the first (43) and second (46) shaft contacts.

When the housing (10) is assembled, the second nock portion (14) is positioned into the bore opening (18) on the proximal end (16) of the first nock portion (13), such that the stepped surface (20) frictionally fits against an outer surface of the second nock portion's first end (25).

The lighting components (11) are contained within the first bore (17) of the housing (10). The body (37) of the light source (34) is positioned toward the distal end (15) of the first nock portion (13) while the first (38) and second (39) light leads are positioned closer to the bore opening (18) at the proximal end (16). The light base (35) is disposed between the first (38) and second (39) light leads.

The first (17) and second (27) bores of the respective first (13) and second (14) nock portions are in communication with each other when the housing is assembled. Consequently, the body casing (48) of the battery (47) is positioned within the second bore (27) of the second nock portion (14), while the terminal projection (59) extends into and contacts the base bore (40) of the light base (35) disposed in the first nock portion (13).

Figure 4:
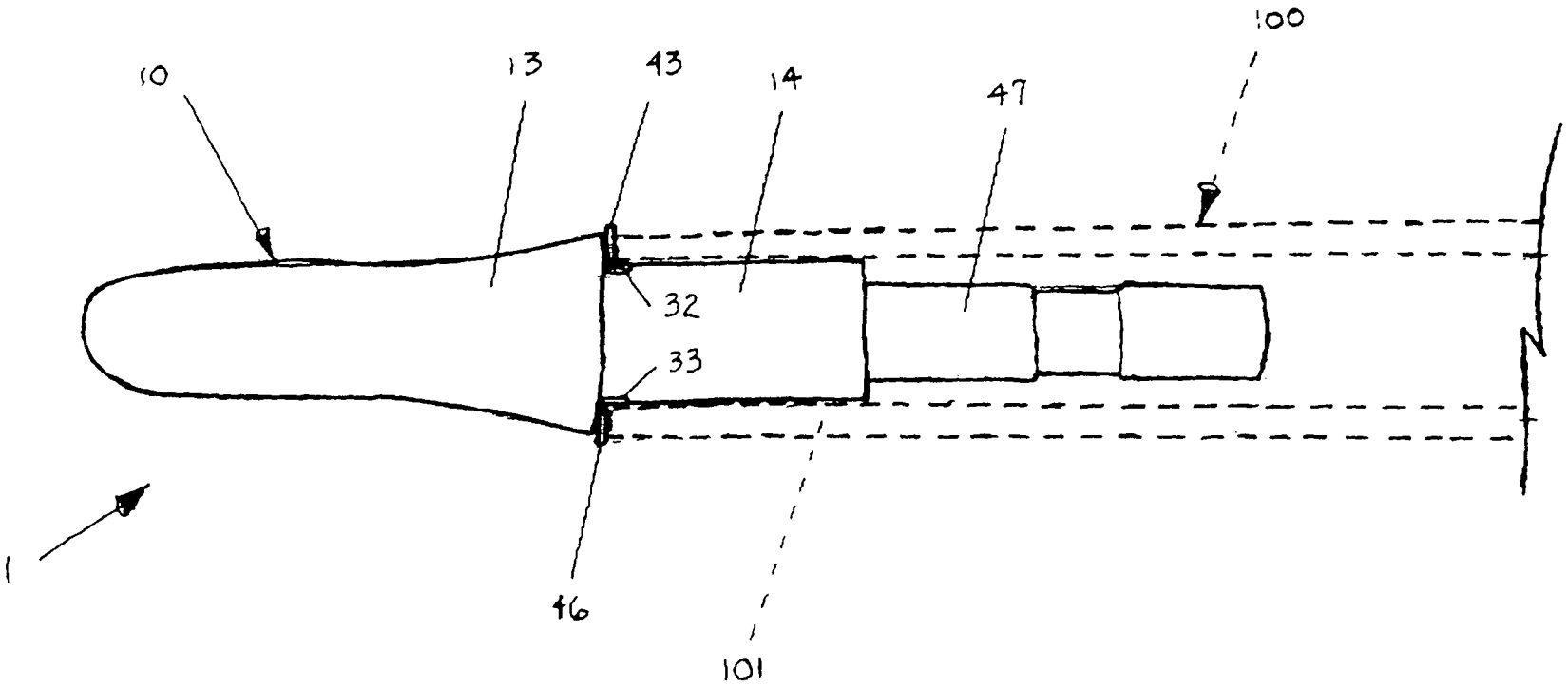
FIG. 4 is a perspective view of the illuminated nock assembly of FIG. 1 with an arrow shown in dotted lines mounted on the housing.

With the electrode contacts (36), the first connector (41) is positioned such that the first shaft contact (43) extends through the first slot (32) and outwardly from the housing (10). Furthermore, the first shaft contact (43) lies adjacent to the end wall (22) of the first nock portion (13) as shown in FIGS. 2 and 4. The connecting leg (44) of the first connector (41) is disposed within the second bore (27) of the second nock portion (14). The leg (44) is adjacent to and in contact with the sides (50) of the battery's body casing (48). The connecting leg (44) is in electrical contact with the battery (47).

The second connector (42) is positioned such that the coil (45) encircles the second light lead (39) of the light source (34) within the first nock portion (13) and is in electrical contact with the light source (34). The second shaft contact (46) of the second connector (42) extends through the second slot (33) in the second nock portion (14) and outwardly from the housing (10). The second shaft contact (46) lies adjacent to the end wall (22) of the first nock portion (13).

It is desirable that the first (13) and second (14) nock portions be sized properly relative to each other in order for the portions (13, 14) to frictionally fit together. Such sizing can be difficult to obtain when the portions (13, 14) are cast separately in the manufacturing process. To achieve consistency in the sizes of the portions (13, 14), the first (24) and second (31) wall thicknesses of the respective first (13) and second (14) nock portions are approximately equal in magnitude. With the first (24) and second (31) wall thicknesses being approximately the same magnitude, any shrinkage and bubbling that might occur during the casting process will be about the same in both portions (13, 14). Consequently, the size of each of the first (13) and second (14) portions will be more consistent. This results in a more reliable fit between the first (13) and second (14) nock portions.

On the second nock portion (14) of the housing (10), the first (32) and second (33) slots are disposed approximately opposite to each other around the first opening (28). The first (43) and second (46) shaft contacts of the electrode contacts (36) extend radially outwardly from the second nock portion (14). Both of the first (43) and second (46) shaft contacts abut the end wall (22) of the first nock portion (13).

Referring to FIGS. 1 and 4, the illuminated nock assembly (1) is adapted for use with an arrow (100) having a shaft (101) that is made of an electrically conductive material. During use, the arrow shaft (101) is positioned over the second end (26) of the housing's second nock portion (14) and then moved toward the end wall (22) of the first nock portion (13), until the shaft is adjacent the end wall (22) and abuts the first (43) and second (46) shaft contacts. The arrow shaft (101) acts as an electrical connection between the first shaft contact (43) and the second shaft contact (46). Since the first shaft contact (43) is in electrical contact with the battery (47) and the second shaft contact (46) is in electrical contact with the light source (34), the arrow's shaft (101) completes the circuit between the light source (34) and the power source (12), thereby connecting the light source (34) to the battery (47). As a result of the completed circuit between the light source (34) and the power source (12), the light source (34) is illuminated.

When the arrow (100) is removed from the illuminated nock assembly (1), the circuit is opened or broken between the first (43) and second (46) shaft contacts so that the power is no longer flowing to the light source (34). With no power flowing to the light source (34), illumination ceases within the nock assembly (1).

The illuminated nock assembly of the present invention provides a two part housing which simplifies the assembly process and reduces potential damage to the electrode contacts during assembly, thereby reducing the cost of manufacture. In addition, the similar wall thicknesses of the two portions comprising the housing promote sizing consistency during the casting process, resulting in a more reliable fit between the parts. It should also be appreciated that casting the present invention's housing as two separate portions simplifies the casting mold structure. Simplifying the casting mold for the housing can reduce the occurrence of residual stress during the manufacturing process. This results in diminished cracking and fatigue of the molded portions, thereby increasing the production yield and lowering the manufacturing costs.

Although the present invention has been described in considerable detail with reference to certain preferred versions thereof, other versions are possible. Therefore, the spirit and scope of the appended claims should not be limited to the description of the preferred versions contained herein.

The invention claimed is:

1. An illuminated nock assembly for engaging the shaft of an arrow that is adapted for use with an archery bow having a bowstring, the illuminated nock assembly comprises:

a housing;

lighting components for illuminating the nock assembly; and a power source;

said housing includes first and second nock portions;

said first nock portion has proximal and distal ends;

said first nock portion further comprises a groove for receiving the bowstring and a first bore;

wherein said first bore is disposed on said proximal end and said groove is disposed on said distal end of said first nock portion;

said first bore comprises a bore opening having a stepped surface which includes an abutment wall;

wherein said first bore receives said second nock portion therein, at least a portion of said stepped surface frictionally secures said second nock portion, and said abutment wall limits insertion of the second nock portion into said first bore of the first nock portion;

said first nock portion further comprises a first portion wall having a first wall thickness on said proximal end and an end wall extending around the bore opening;

said second nock portion has first and second ends and further comprises a second bore and a second portion wall;

said second bore having first and second openings, wherein said first opening is disposed at said first end of said second nock portion, and said second opening is disposed at said second end of said second nock portion;

said second portion wall having first and second slots and a second wall thickness;

wherein said first and second wall thicknesses are approximately equal in magnitude and said first and second slots are disposed on said first end of said second wall portion;

said lighting components include a light source, a light base and a plurality of electrode contacts;

said light source comprises a body and first and second light leads;

said light base includes a base bore;

said plurality of electrode contacts are comprised of electrically conductive material and further comprise first and second L-shaped connectors;

said first connector comprises a first shaft contact and a connecting leg;

said second connector comprises a coil and a second shaft contact;

said power source includes a body casing having sides and a terminal projection;

wherein said terminal projection extends into said base bore and contacts said light base;

wherein said first connector electrically connects the power source to the arrow shaft and said second connector electrically connects the light source to the arrow shaft;

wherein said first shaft contact of said first connector is disposed in the first slot on said second nock portion and lies adjacent to the end wall of the first nock portion; and wherein said second shaft contact of the second connector is disposed in the second slot on said second nock portion and lies adjacent to the end wall of the first nock portion;

said connecting leg of the first connector is adjacent to and in electrical contact with the body casing and said coil of said second connector at least partially surrounds the second light lead of the light source;

wherein when said light source is in electrical contact with said power source, the arrow shaft is disposed on said second nock portion and is in contact with said first and second shaft contacts to complete an electrical circuit between said light source and said power source, and said light source is illuminated; and wherein when said light source is out of electrical contact with said power source, the arrow shaft is out of contact with said first and second shaft, and said light source is not illuminated.

2. The illuminated nock assembly of claim 1, wherein said power source comprises a 3-volt lithium battery and said light source comprises a light-emitting diode.

3. An illuminated nock assembly comprises:

a housing including first and second separable, interfitting nock portions;

lighting components for illuminating the nock assembly; and a power source;

wherein said lighting components are substantially housed in said first and second nock portions and can be selectively illuminated; said first nock portion includes proximal and distal ends and a first bore disposed on said proximal end; said second nock portion includes first and second ends and a second bore; and said first end of said second nock portion is disposed within said first bore of said first nock portion.

4. The illuminated nock assembly of claim 3, wherein said lighting components comprise a light source, a light base and a plurality of electrode contacts, when said light source is in electrical contact with said power source, said light source is illuminated; and when said light source is out of electrical contact with said power source, said light source is not illuminated.

5. The illuminated nock assembly of claim 4, wherein said housing is translucent.

6. The illuminated nock assembly of claim 3, wherein said first nock portion further comprises a first portion wall having a first wall thickness, and said second nock portion further comprises a second portion wall having a second wall thickness; and wherein said first wall thickness and said second wall thickness are approximately equal in magnitude.

7. The illuminated nock assembly of claim 3, wherein said first bore comprises a stepped surface and at least a portion of said stepped surface frictionally secures said second nock portion within said first bore.

8. The illuminated nock assembly of claim 7, wherein said stepped surface includes an abutment wall which limits insertion of the second nock portion into said first bore of the first nock portion.

9. An illuminated nock assembly for engaging the shaft of an arrow that is adapted for use with an archery bow having a bowstring, the illuminated nock assembly comprises:

a housing comprising first and second separable, interfitting nock portions;

lighting components for illuminating the nock assembly; and a power source;

said lighting components comprising a light source, a light base and first and second electrode contacts;

said light source includes a body having first and second light leads that communicate between the body of the light source and the electrode contacts;

said electrode contacts comprise an electrically conductive material and further comprise first and second connectors that respectively connect with the first and second light leads;

wherein said lighting components are substantially housed in said first and second nock portions and can be selectively illuminated.

10. The illuminated nock assembly of claim 9, wherein said lighting components comprise a light source, and a plurality of electrode contacts;

wherein said light source is in electrical contact with said power source when the arrow shaft is disposed on said second nock portion and in direct contact with said electrode contacts, thereby creating a closed electrical circuit and said light source is illuminated; and wherein said light source is out of electrical contact with said power source when the arrow shaft is not in contact with the electrode contacts, the electrical circuit is open and said light source is not illuminated.

11. The illuminated nock assembly of claim 9, wherein said power source comprises a battery.

12. The illuminated nock assembly of claim 11, wherein said first connector includes a first shaft contact and a connecting leg, and said second connector includes a coil and a second shaft contact.

13. The illuminated nock assembly of claim 12, wherein when said connecting leg of the first connector contacts the battery and said coil of said second connector at least partially surrounds the second light lead of the light source and said first and second shaft contacts selectively engage the arrow shaft.

14. The illuminated nock assembly of claim 13, wherein said first nock portion comprises a first bore and an end wall, said second nock portion comprises a second bore and first and second slots, and said second nock portion is at least partially disposed within said first bore.

15. The illuminated nock assembly of claim 14, wherein said battery is disposed in said first and second bores, said first shaft contact is disposed in said first slot, said second shaft contact is disposed in said second slot, and said first and second shaft contacts are adjacent to said end wall of the first nock portion.

16. The illuminated nock assembly of claim 12, wherein when said light source is illuminated, the arrow shaft is disposed on said second nock portion and is in contact with said first and second shaft contacts to complete an electrical circuit between said light source and said power source; and when said light source is not illuminated, the arrow shaft is out of contact with said first and second shaft contacts and the electrical circuit between the light source and the power source is open.

17. The illuminated nock assembly of claim 12, wherein said first and second connectors are generally L-shaped.

18. The illuminated nock assembly of claim 9, wherein said first and second electrode contacts form a closed circuit with the first and second connectors, the arrow shaft, and the battery to illuminate the body of the light source.

19. In combination, an illuminated nock assembly and an arrow shaft, wherein the illuminated nock assembly comprises:

a housing including first and second separable, interfitting nock portions, lighting components for illuminating the nock assembly, and a power source in electrical contact with said lighting components;

said lighting components include a light source and a plurality of electrode contacts, wherein said lighting components are substantially housed in said first and second nock portions and can be selectively illuminated;

said arrow shaft comprises an electrically conductive material and is adapted to fit around at least part of the second nock portion;

wherein when said arrow shaft is in contact with said electrode contacts, a closed electrical circuit is created that illuminates said light source; and when said arrow shaft is out of contact with said electrode contacts, the electrical circuit is open and said light source is not illuminated.

* * * * *